United States Patent [19]

Merwarth et al.

[11] Patent Number: 5,046,711

[45] **Date of Patent: * Sep. 10, 1991**

[54] HIGH SPEED DRUM TYPE PROCESSING APPARATUS

[75] Inventors: Richard J. Merwarth, Westlake; Brian K. Happel, Bay Village, both of Ohio

[73] Assignee: Hall Processing Systems, Westlake, Ohio

[ * ] Notice: The portion of the term of this patent subsequent to Mar. 21, 2006 has been disclaimed.

[21] Appl. No.: 324,463

[22] Filed: Mar. 16, 1989

Related U.S. Application Data

[63] Continuation of Ser. No. 149,699, Jan. 29, 1988, Pat. No. 4,813,662.

[51] Int. Cl.[5] ..... B65H 5/08

[52] U.S. Cl. ..... 271/11; 271/82; 271/187; 271/277; 271/315

[58] Field of Search ..... 271/11, 31.1, 82, 94, 271/314.96, 95, 94, 105, 106, 315, 276; 198/689.1, 471.1, 476.1, 704

[56] References Cited

U.S. PATENT DOCUMENTS

| | | | |
|---|---|---|---|
| 3,041,068 | 6/1966 | Schaltegger . | |
| 3,147,007 | 9/1964 | Gore . | |
| 3,521,879 | 7/1970 | Niemeyer . | |
| 3,540,721 | 11/1970 | Blowsky | 270/58 |
| 3,710,928 | 1/1973 | van Zijp . | |
| 3,720,409 | 3/1973 | Kubo et al. . | |
| 3,797,677 | 3/1976 | Grachev et al. . | |
| 3,810,612 | 5/1974 | McCahon et al. . | |
| 3,951,399 | 4/1976 | Reist . | |
| 4,058,202 | 11/1977 | Reist et al. . | |
| 4,127,262 | 11/1978 | Eberle et al. . | |
| 4,145,038 | 3/1979 | Mol . | |
| 4,350,466 | 9/1982 | Bahr et al. . | |
| 4,390,093 | 6/1983 | Chard, Jr. et al. . | |
| 4,399,905 | 8/1983 | Lance et al. . | |
| 4,405,122 | 8/1983 | Faltin . | |
| 4,459,172 | 7/1984 | Achelpohl et al. . | |
| 4,482,145 | 11/1984 | Feldkamper et al. . | |
| 4,520,933 | 6/1985 | Reiff . | |
| 4,521,271 | 6/1985 | Voltmer et al. | 271/112 |
| 4,537,390 | 8/1985 | Kiamco et al. . | |
| 4,555,101 | 11/1985 | Stobb . | |
| 4,560,070 | 12/1985 | Cribiu et al. . | |
| 4,732,374 | 3/1988 | Honegger . | |
| 4,813,662 | 3/1989 | Merwarth et al. | 271/315 |
| 4,901,996 | 2/1990 | Schlough | 271/11 |

*Primary Examiner*—H. Grant Skaggs

*Attorney, Agent, or Firm*—Fay, Sharpe, Beall, Fagan, Minnich & McKee

[57] ABSTRACT

An apparatus for processing sheet products includes a rotatable drum having a plurality of pockets adapted to receive individual sheet products. Plural rollers are disposed along the periphery of the drum between adjacent pocket openings. The rollers are rotated through a portion of the drum movement and locked against rotation through the remainder of the drum movement. Cam means are provided to lift the pockets radially outward, tilt the pockets, and open and close sidewalls of the pockets to facilitate ingress and egress of the sheet products.

17 Claims, 8 Drawing Sheets

HIGH SPEED DRUM TYPE PROCESSING APPARATUS

BACKGROUND OF THE INVENTION

This invention is a continuation of Ser. No. 149,699, filed Jan. 29, 1988 now U.S. Pat. No. 4,813,662 and pertains to the art of processing sheet products and more particularly to processing a stack of sheet products to a conveyor system that handles each sheet product on an individual basis.

The invention is particularly applicable to receiving a stack of sheet products whether they be newspapers, inserts, periodicals, magazines, etc. The term "sheet products" will be understood to refer to these and similar products. The subject new apparatus is adapted to handle a high volume o( sheet products for a variety of different operations.

By way of example, the sheet products may be a stack of newspapers received from a printing press. At printing press speeds approximating 60,000 to 100,000 newspapers per hour, downstream equipment must keep up with the supply and prepare the newspapers for handling in various downstream stations such an stuffing or inserting, stacking and the like. Prior processing machinery has been unable to maintain pace with the increasing press speed resulting from advanced technological innovations in that area. To accommodate the high output of the printing machinery, it has heretofore been necessary to employ plural processing devices to handle large numbers of sheet products. Even then, maintenance of plural conveyor lines associated with plural processing devices adds to the increased cost of handling sheet products. An increased need has developed to provide an on-line processing apparatus that is able to handle large numbers of sheet products in an efficient manner. The apparatus has to effectively convey between a stack of sheet products on one side and a conveyor system on the other side that handles each sheet product individually. Therefore, the apparatus must accurately and quickly separate the sheet products from the stack, quickly move the sheet products to an outfeed location, and present individual sheet products for pickup by grippers spaced along a conveyor system.

Further constraints are placed on the system because of the type of product; namely, sheet products which require special handling. The processing equipment must be able to adapt to various thicknesses of the sheet products as experienced in a newspaper processing system. Typically, the newspaper thickness will vary from day to day, or even in different printing runs on the same day. Also, the flexible nature of the sheet product requires special handling in transferring the product from a stack to the processing apparatus, as well as transferring this same product from the processing apparatus to the conveyor system.

Nevertheless, the present invention is not restricted to receipt of papers from a printing press but is applicable to any general processing of sheet products. It will be appreciated that the invention has broader applications in all these fields and may be advantageously employed in still other sheet product environments and applications.

The present invention contemplates a new and improved processing apparatus that overcomes all of the above referred to problems and others and provides an economical, efficient processing apparatus.

SUMMARY OF THE INVENTION

According to the subject invention, a processing apparatus includes a rotatable drum having plural, radially disposed pockets adapted to receive sheet products therein. Rollers are defined along the periphery of the drum between pocket openings and are adapted to engage an associated stack of sheet products and transfer the sheet products one-by-one into a respective pocket. The rollers are rotated relative to the drum through a preselected portion of the drum rotation. Thereafter, the rollers are locked against rotation for the remainder of the drum rotation.

According to yet another aspect of the invention, means for selectively actuating movement of pocket sidewalls toward and away from one another to grip the associated sheet products is provided.

According to yet another aspect of the invention, means for actuating radial movement of the pockets toward and away from the periphery of the drum is provided.

According to still another aspect of the invention, means for tilting the pockets is provided.

A primary advantage of the invention resides in the ability to process a large number of sheet products in an efficient manner.

Another advantage of the invention resides in pockets that open and close to facilitate gripping of the sheet products.

Yet another advantage of the invention is realized in the radial movement of the pockets to assist in removal of the sheet products from the rotating drum.

Still another advantage is found in the tilting of the pockets to facilitate ingress/egress of sheet products to and from the pockets.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
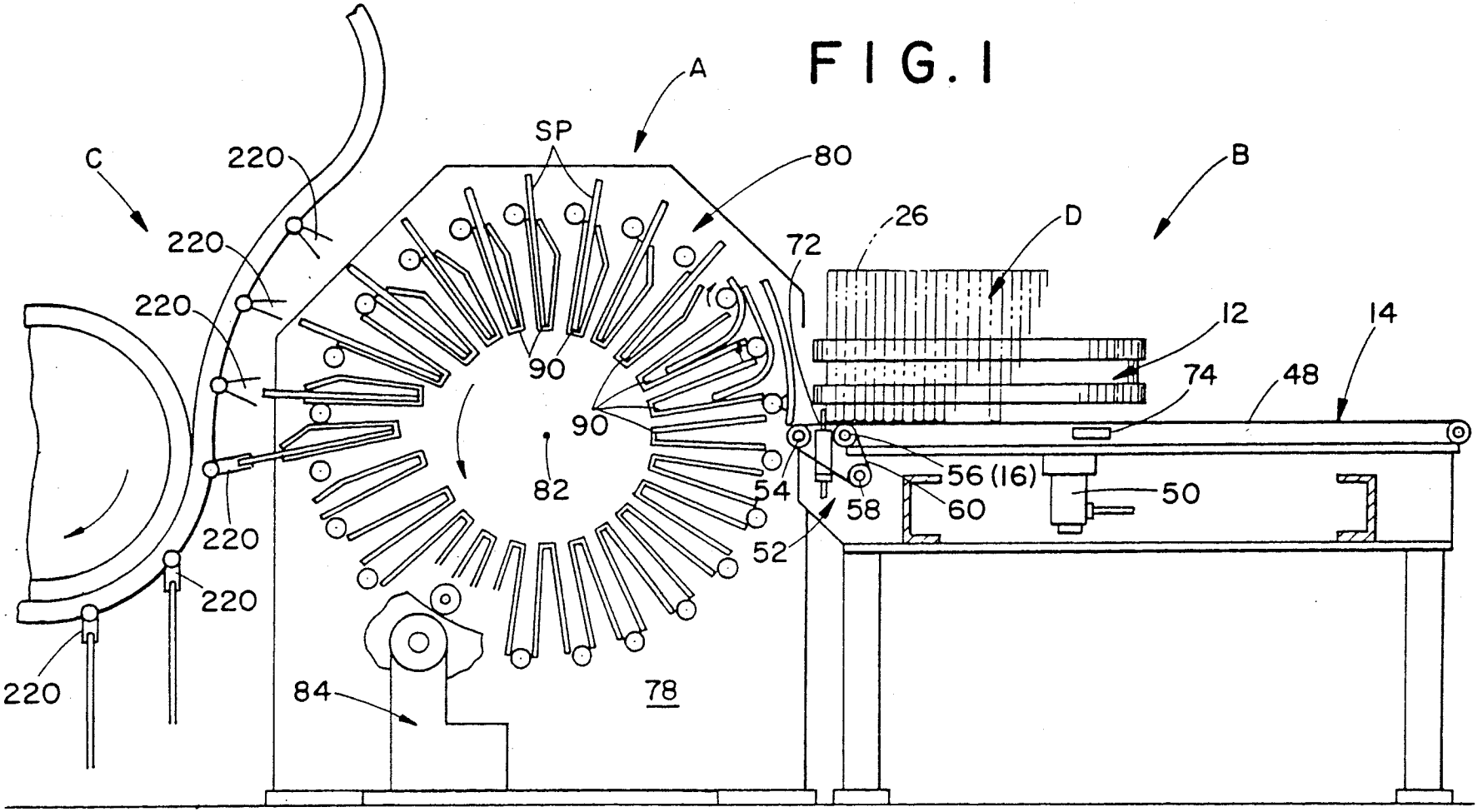
FIG. 1 is a side elevational view of the subject new drum type processing apparatus disposed between an infeed mechanism and a pickup conveyor with selected portions shown in cross-section to illustrate details thereof.

Referring now to the drawings wherein the showing are for purposes of illustrating the preferred embodiment of the invention and not for purposed of limiting same, the FIGURES show a processing apparatus or high speed drum type feeder A interposed between an infeed mechanism B and a gripper conveyor C.

Figure 2:
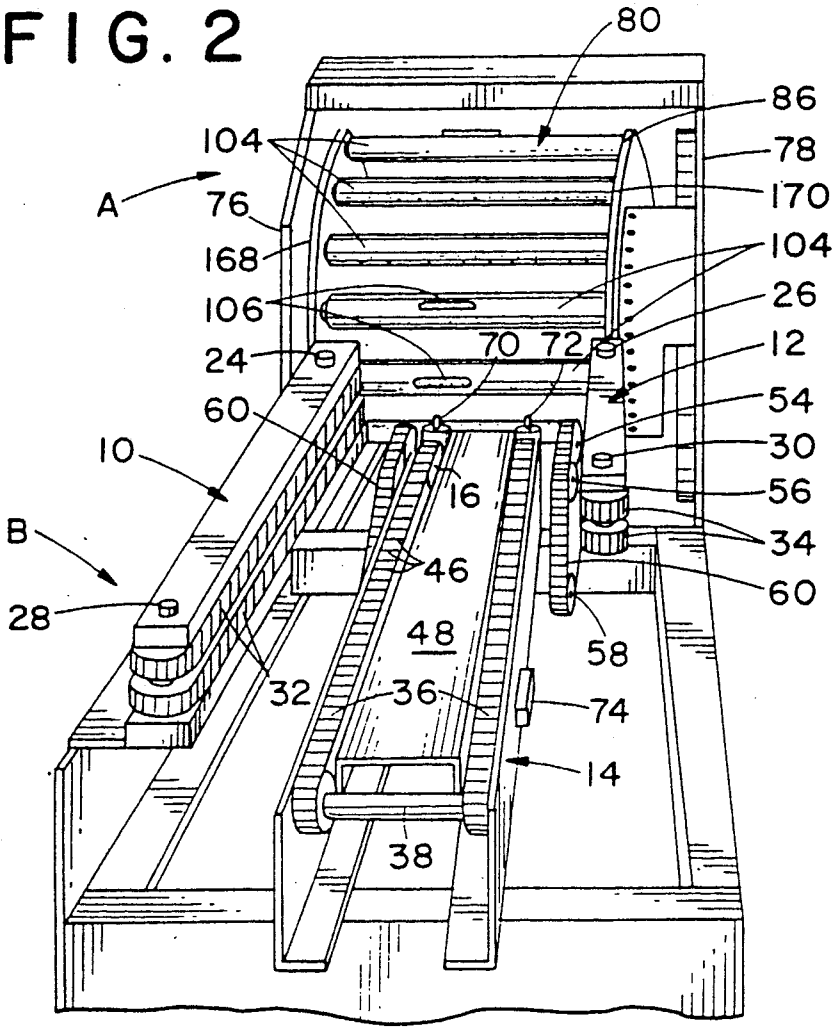
FIG. 2 is a perspective view of the infeed mechanism and the drum type processing apparatus according to the subject invention.

More particularly, and with reference to FIGS. 1 and 2, a printing press or other processing state (not shown) provides a stack D of sheet products SP, such as newspapers, to the infeed mechanism B for processing by the high speed drum type feeder A. The infeed mechanism includes opposed first and second sidewalls 10, 12, and a third or bottom wall 14 for supporting the stack of sheet products along three sides. According to the preferred embodiment, the second sidewall 12 is selectively movable toward and away from the first sidewall 10 by shifting the second sidewall along a horizontally disposed shaft 16 Any conventional adjustable clamping arrangement can be utilized to secure the second sidewall and shaft 16 together. The shaft 16 is driven by an associated drive means such a direct drive motor, drive belt, or other drive transmission arrangements (not shown). Generally vertical extending shafts 24, 16 are interconnected with the shaft 16 through a right angle gear box or similar horizontal-to-vertical drive arrangement. The specific details of the right angle gear box do not form a part of the invention and further discussion thereof is deemed unnecessary.

Vertically extending idler shafts 28, 30 are associated with the shafts 24, 26, respectively. The shaft pair 24, 28 receives a pair of belts 32 therearound to define the first sidewall 10. Likewise, the shaft pair 26, 30 receives a pair of spaced belts 34 therearound to define the second sidewall 12. Still further, a pair of belts 36 are received around the shaft 16 and a corresponding idler shaft 38 to define the bottom wall 14. Each of the belts 32, 34, 36 includes discrete teeth or cogs 46 adapted to drivingly engage the sheet products and advance the stack toward the drum processing apparatus A. Since the shafts 16, 24, 26 are synchronously driven, the belt pairs 32, 34, 36 advance the sheet product stack toward the drum processing apparatus at the same rate.

The bottom wall 14 includes a vibrating plate 48 disposed between belt pair 36 and driven by a vibrating means such as an eccentric motor or reciprocating piston device 50. Preferably, the vibrating plate is a rigid structure. The plate has a generally smooth, planar upper surface that permits the sheet product stack to slide easily thereover. The vibrating plate assists in orienting the sheet products for individual receipt into the drum processing apparatus as will be fully described hereinbelow.

An auxiliary infeed mechanism 52 is provided between the shafts 16, 24, 26 and the drum processing apparatus A. The auxiliary infeed mechanism includes three shafts 54, 55, 58 that synchronously rotate with the remainder of the infeed mechanism B. These shafts can be driven by a separate drive means (not shown) from that of the remainder of the infeed mechanism or commonly driven if so desired. A toothed belt 60 extends around the shafts 54, 56, 58 to bridge the gap between the belts 32, 34, 36 of the main infeed mechanism and the drum processing apparatus. Specifically, shafts 56, 58 are disposed below the horizontal plane defined by the top surface of the vibrating plate 48 and axially behind a vertical plane defined by shafts 24, 26. In this manner, the portion of the belt 60 that extends between shafts 54, 58 is disposed down and away from the rotational path of the drum processing apparatus A so that the sheet products are advanced as close as possible to the drum processing apparatus without interfering with rotation thereof. The belt 60 of the auxiliary infeed mechanism provides a driving engagement to the sheet product stack to a point immediately adjacent the periphery of the drum processing apparatus.

First and second gate pins 70, 72 are located adjacent the inner end of the vibrating plate 48. The pins are pneumatically actuated to selectively extend above and below the horizontal plane defined by the upper surface of the vibrating plate. A signal provided by sensor 74 actuates the gate pins to reciprocate above and below the horizontal plane of the vibrating plate to prevent and permit advancement of the individual sheet products of the stack into the processing apparatus. Since the thickness of the sheet products can change from one operating run to the next, the reciprocating or cycling action of the gate pins 70, 72 can likewise be altered to accommodate these variations in thickness.

In the preferred operation of the infeed mechanism the sheet products of the stack are disposed so that the folded edges of the sheet products SP are disposed along the bottom wall 14. In other words, the open or free ends of the sheet products are disposed upwardly to define the only unsupported surface of the sheet products. The toothed belts engage the folded edges of the sheet products for advancement toward the drum processing apparatus.

The second sidewall 12 has a reduced axial length relative to the first sidewall 10. This arrangement allows the sheet products to be fed to the infeed mechanism from a direction generally perpendicular to the path of belts 32, 34, 36. The sheet products are loaded from the side of the infeed mechanism adjacent the second sidewall, across the bottom wall 14, and into abutting engagement with the first sidewall. Thereafter, the sheet products are advanced by the belts toward the drum processing apparatus. It will be understood that the first sidewall could alternatively be shorter than the second sidewall to receive products from the other side of the infeed mechanism if desired.

Figure 3:
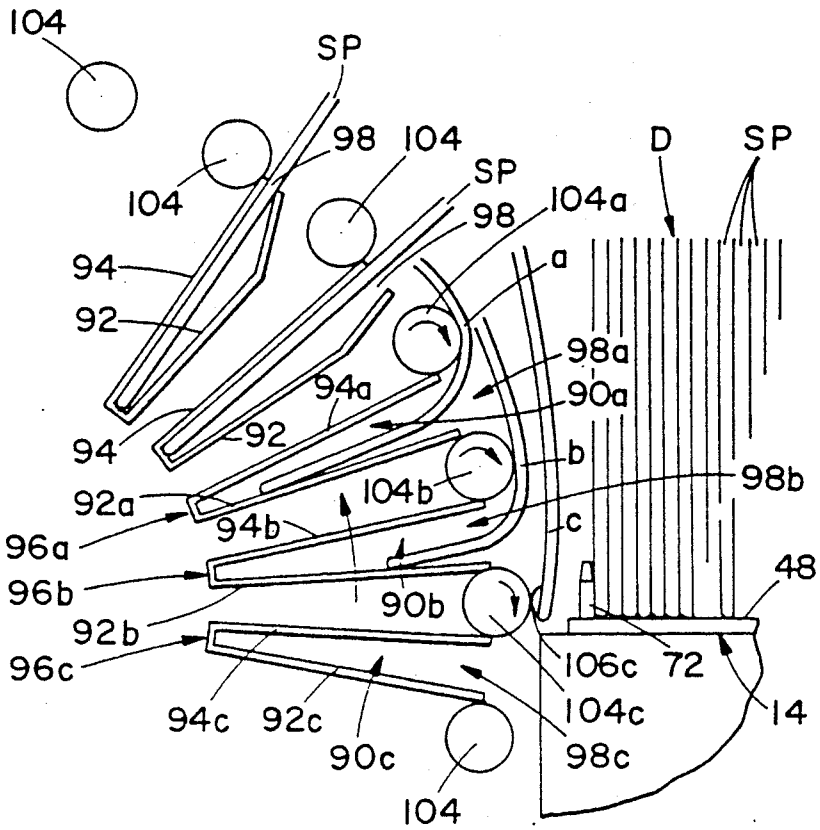
FIG. 3 is an enlarged view illustrating the transfer of sheet products from the infeed mechanism into selected drum pockets.

The drum processing apparatus A includes an external frame or housing defined by opposed side plates 76, 78. The side plates are typically secured to further exterior framework (not shown). The frame side plates support a drum 80 for rotation about a horizontal central axis 82. Motor 84 drives the drum 80 through any conventional manner such as a drive sprocket and toothed wheel arrangement. The particulars of the drive arrangement form no part of the subject invention so that further discussion thereof is deemed unnecessary. The drum has a generally cylindrical configuration defined by a circular outer periphery 86. Plural pockets 90 of substantially identical construction are defined in the drum so that description of one pocket is applicable to the other pockets. The pockets are generally radially disposed for selective receipt of individual sheet products. Each pocket includes radially extending sidewalls 92, 94 interconnected along a bottom wall 96 (FIG. 3). The radially outer portions of the sidewalls are spaced apart defining a pocket opening 98 adapted to receive the sheet products therein.

A plurality of rollers 104 are circumferentially disposed along the periphery of the drum. A roller is disposed between contiguous pockets, that is between a sidewall 92 of one pocket and a sidewall 94 of an adjacent pocket. In this manner, each pocket 90 has a roller 104 associated therewith.

To distinguish between the adjacent rollers and pockets, a small alphabetical suffix will delineate between the different pockets and rollers. Nevertheless, it will be understood that each roller and pocket configuration is substantially identical to its counterparts. Likewise, each sheet product SP will be identified by a corresponding letter set apart in quotations, "", to facilitate an understanding of the infeed and operation of the drum processing apparatus.

Specifically, roller 104*c* is rotated by the drum assembly to a position adjacent the lower, inner folded edge of the stack of sheet products. A sucker or vacuum region 106*c* is defined on the roller and faces outwardly from the drum apparatus for engagement with the lower edge of sheet product "c". Through suitable means for supplying a vacuum to the sucker region to be described hereinbelow, secure engagement between the roller and lower edge of sheet product "c" is completed. As shown in FIG. 3, the drum apparatus is rotating in a counterclockwise direction and the rollers, rotating along their own respective axes in a clockwise direction, engage the sheet products and urge one sheet product at a time into a pocket disposed directly below the roller. Thus, roller 104*c* urges sheet product "c" through pocket opening 98*c*.

Roller 104*b* has advanced through approximately 10° of drum rotation in a counterclockwise direction and approximately 90° of clockwise rotation around its own axis so that a greater portion of sheet product "b" has been urged into pocket 90*b*. After the approximately 90° rotation of each roller, the vacuum source is terminated and the frictional engagement between the roller and associated sheet product continues to urge the sheet product into a selected pocket. As shown with roller 104*a*, the vacuum source has been terminated but continued engagement between the rotating roller and associated sheet product "a" further urges the sheet product into the pocket 90*a*.

To assist in separation of the individual sheet products from one another and the remainder of the stack D, stripper or divider bars 108 (FIGS. 8–9) are disposed adjacent each roller along the periphery of the drum 80. When a sheet product is substantially received in an associated pocket, the outer, free edge of the sheet product will engage a stripper bar adjacent the radially outer end of pocket sidewall 94. This prevents the free end of each sheet product from interfering with the next sheet product being fed by an adjacent roller as the drum continues to rotate in a counterclockwise direction.

Figure 4:
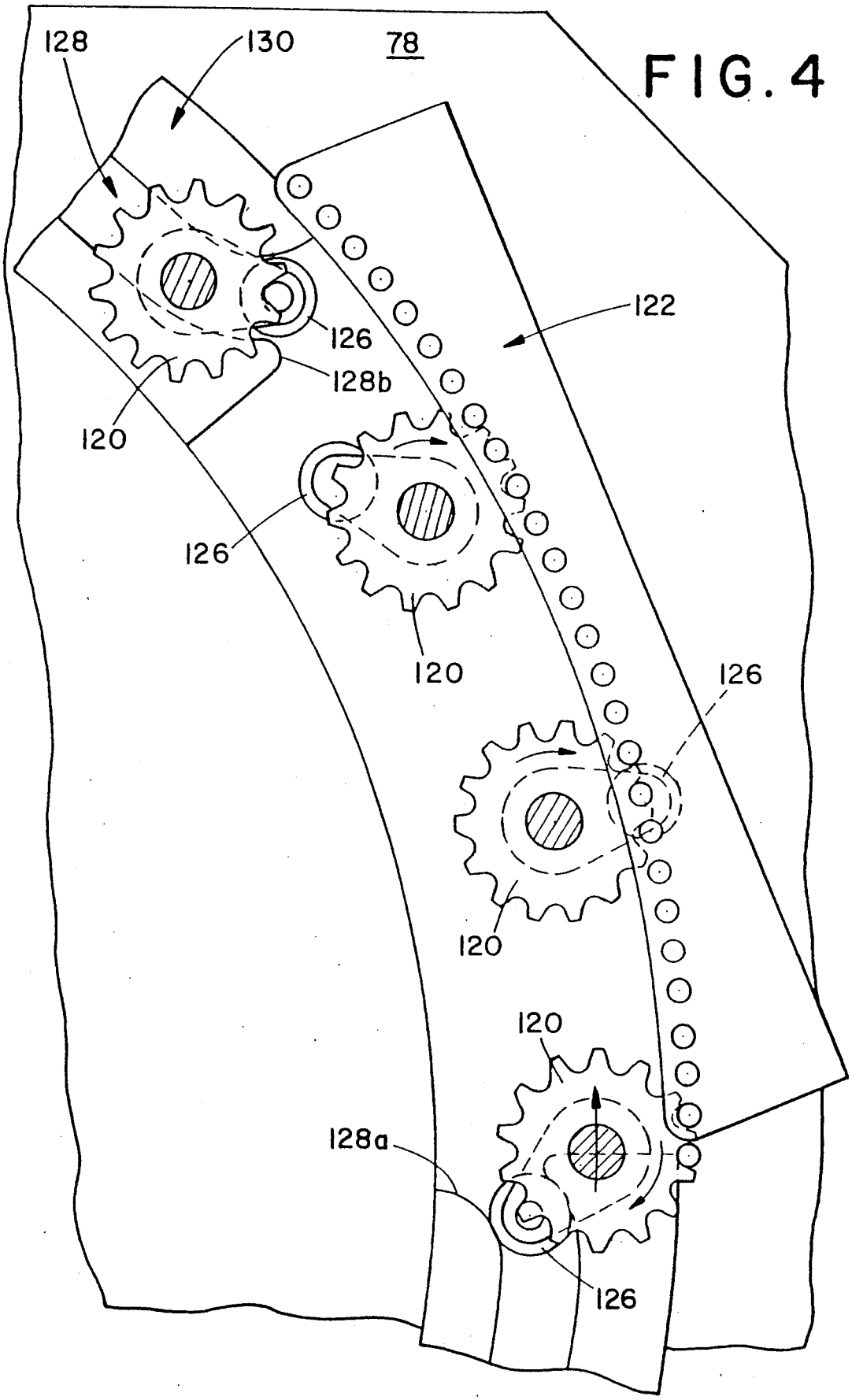
FIG. 4 is an enlarged, detailed view of the means for rotating and means for preventing rotation of the rollers relative to the drum.
Figure 5:
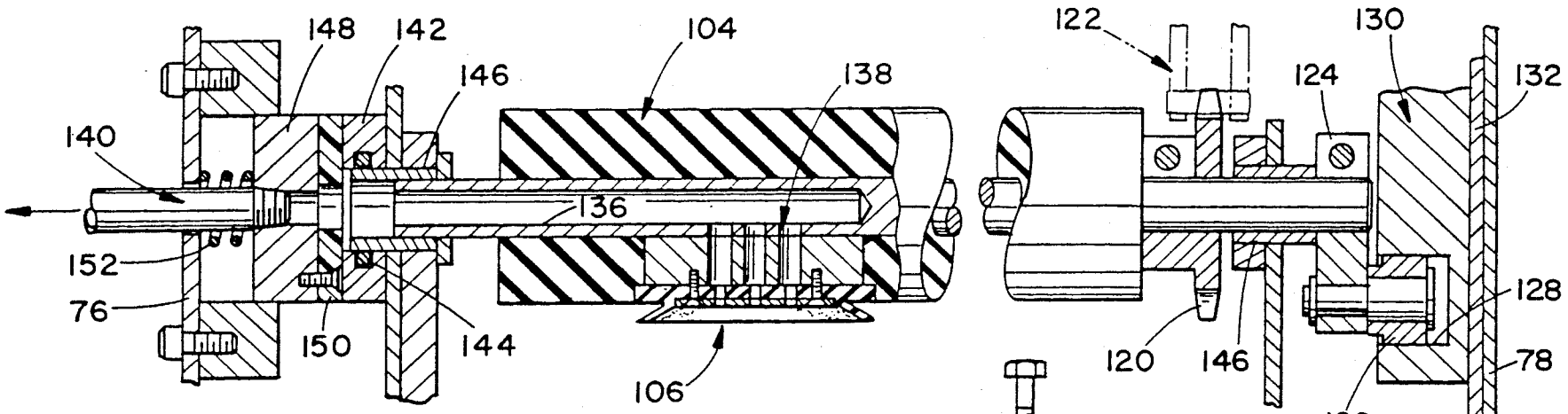
FIG. 5 is an enlarged cross-sectional view of a roller.

In FIGS. 4 and 5, means for selectively rotation the rollers in a clockwise direction about their own axes relative to the counterclockwise rotation of the drum 80 is more particularly illustrated. The right-hand end of each roller includes a sprocket 120 fixed to the roller. A rack assembly 122 is comprised of a series of pins and the rack assembly mounted to frame side plate 78. As the drum rotates in a counterclockwise direction, the sprockets engage the individual pins of the rack assembly to actuate clockwise rotation of the rollers around their own axes. The rollers will rotate at the some speed as the drum under this arrangement.

Rotation of the rollers takes place through approximately 40° of the drum rotation. Through the remaining approximately 320° of drum rotation, the rollers are locked against further rotation by a cam arrangement. As shown in FIG. 5, the right-hand end of each roller includes a depending arm 124 that secures a first cam wheel or cam roller 126 to the roller 104. The cam roller 126 is received in an associated cam track 128 defined in a cam plate 130. The cam plate has a reinforcing plate 132 secured to an outer face that, in turn, is secured to frame side plate 78. The first cam track 128 is generally continuous through 320. (FIG. 12) so that the cam roller 126 locks the individual rollers 104 against rotation through a major portion of the drum movement. Only through the approximately 40° gap defined between 128*a* and 128*b* in the first cam track are the rollers free to rotate as a result of the sprocket and rack assembly arrangement.

As each roller exits the first cam track at location 128*a*, the sucker region is disposed radially outwardly for engagement adjacent the lower folded edge of a sheet product in the stack. A source of vacuum is then provided to the roller through approximately 90° of the roller rotation to grasp the sheet product and urge it toward a selected pocket. Next the source of vacuum is terminated and continued rotation of the roller urges the paper into the pockets. By the time the drum has completed rotation through approximately 40°, i.e., through the arcuate path of the sprocket and rack assembly engagement, the sheet product is completely received in a selected pocket and cam roller 126 reenters the cam track at 128*b*.

Figure 6:
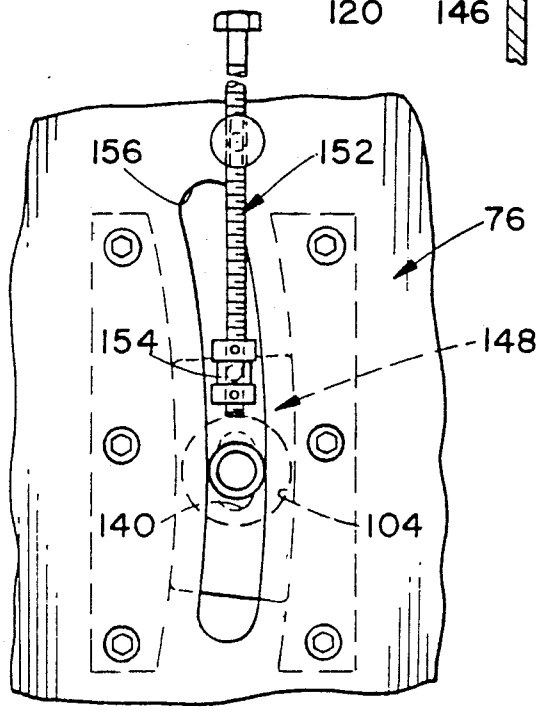
FIG. 6 is a side elevational view of a frame sidewall illustrating the port mechanism for providing a vacuum supply to the rollers through selected arcuate movement of the drum.

With continued reference to FIG. 5, and additional reference to FIG. 6, the means for supplying a source of vacuum to the individual rollers will be set forth in greater detail. Particularly, the rollers have an opening or bore 136 extending axially therethrough. The sucker region 106 communicates with the bore 136 through a sidewall opening 138. The left-hand end of the rollers selectively communicate with a port 110 defined through frame side plate 76. A ring or collar 142 is disposed on the roller and receives a seal member such as O-ring 144 that seals with bushing member 146 disposed on the roller. The collar sealingly engages a port block 148 that has a plastic seal face 150 secured thereto for smooth, sliding engagement with the collar. A biasing means such as spring 152 urges the port block toward the collar.

As represented in FIG. 6, the drum rotates the rollers relative to the frame side plate 76 and the bore 136 of each roller communicates through the port 140 with an external source of vacuum (not shown). Simultaneously, the rollers are rotating about their own axes due to the sprocket/rack assembly arrangement. The combined rotation o( the drum and rollers connects the rollers to the source of vacuum through an approximate 90° rotation of the respective rollers. Therefore, port 140 has an elongated arcuate length, preferably defined in seal face 150, as illustrated in phantom in FIG. 6. The elongated length of the port is preselected to correspond to the circumferential dimension of drum rotation in which the rollers rotate 90° about their own axes.

A means for adjusting the location at which a roller is connected to the vacuum source is also provided. According to the preferred embodiment, the adjusting means includes a threaded member 152 pivotally secured to the frame side plate 76 at one end and follower mechanism 154 at the other end. The follower mechanism is, in turn, secured to port block 148. Rotation of the threaded member moves the follower mechanism along an elongated slot 156 formed in the side plate 76. Since the follower mechanism is fixed to the port block 148, the location at which a roller bore 136 communicates with the vacuum source may be altered.

Due to the flexible nature of sheet products such as newspapers, the pockets must be specially accommodated to facilitate receipt of the individual sheet products from the stack and orient them for pick-up by a gripper conveyor arrangement C. The subject invention incorporates structural features that result in three primary movements of the pockets as the drum rotates to facilitate ingress and egress of the sheet products. Specifically, each pocket will (i) tilt, (ii) move radially relative to the drum, and (iii) open and close grip and receive the sheet products. Each of these actions must be accomplished at a high rate of speed to permit processing of approximately 40,000 sheet products per hour.

Figure 7:
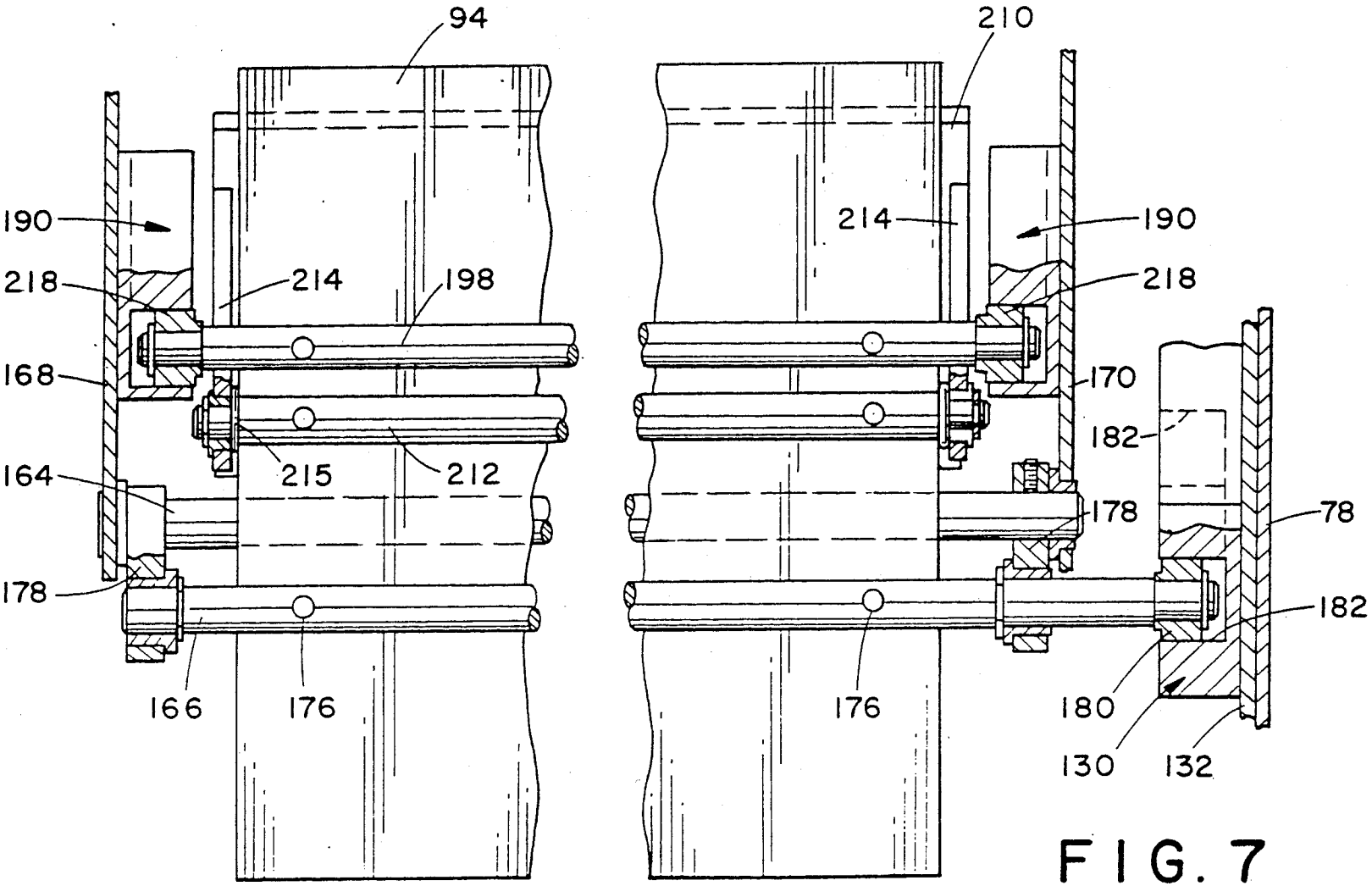
FIG. 7 is an enlarged view of a pocket with selected portions shown in cross-section.
Figure 8:
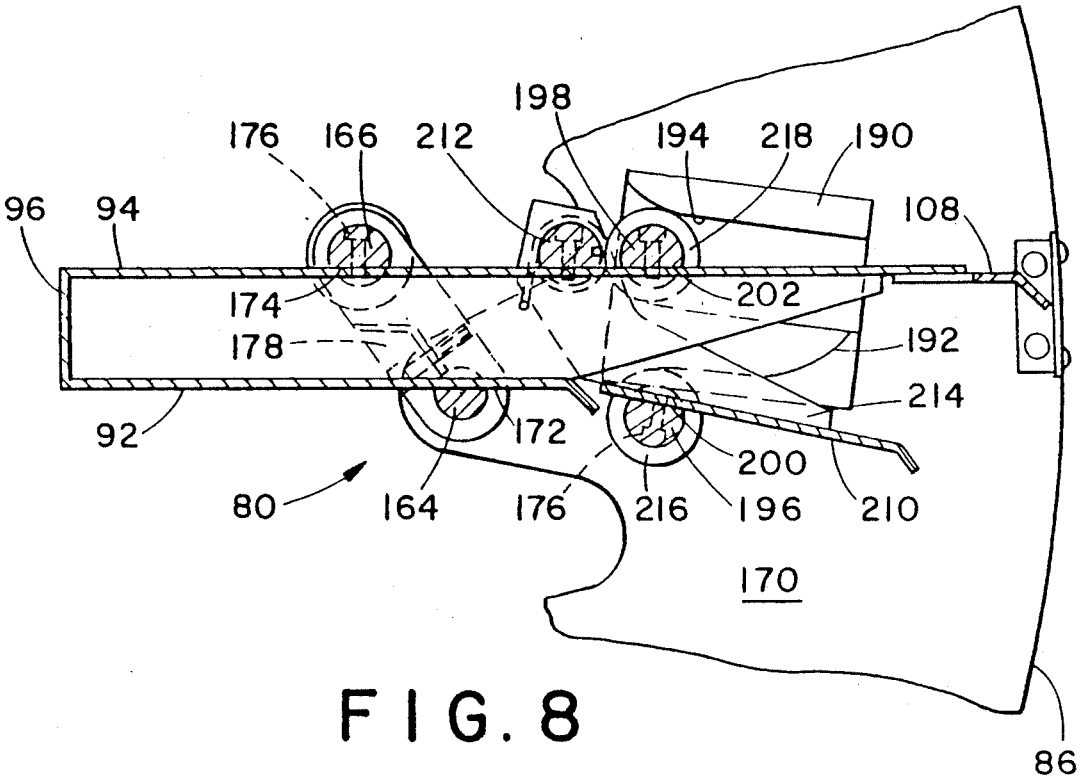
FIG. 8 is a cross-sectional view of a pocket in a radially recessed and open position.
Figure 9:
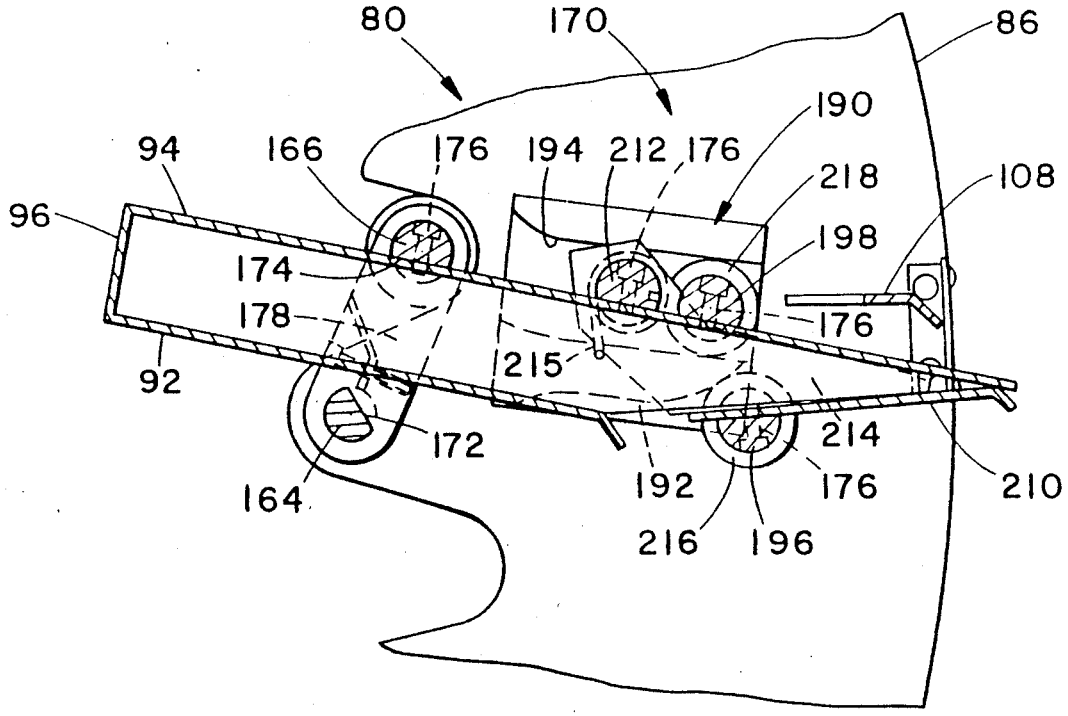
FIG. 9 is a cross-sectional view of a pocket in a radially outward and closed position.
Figure 12:
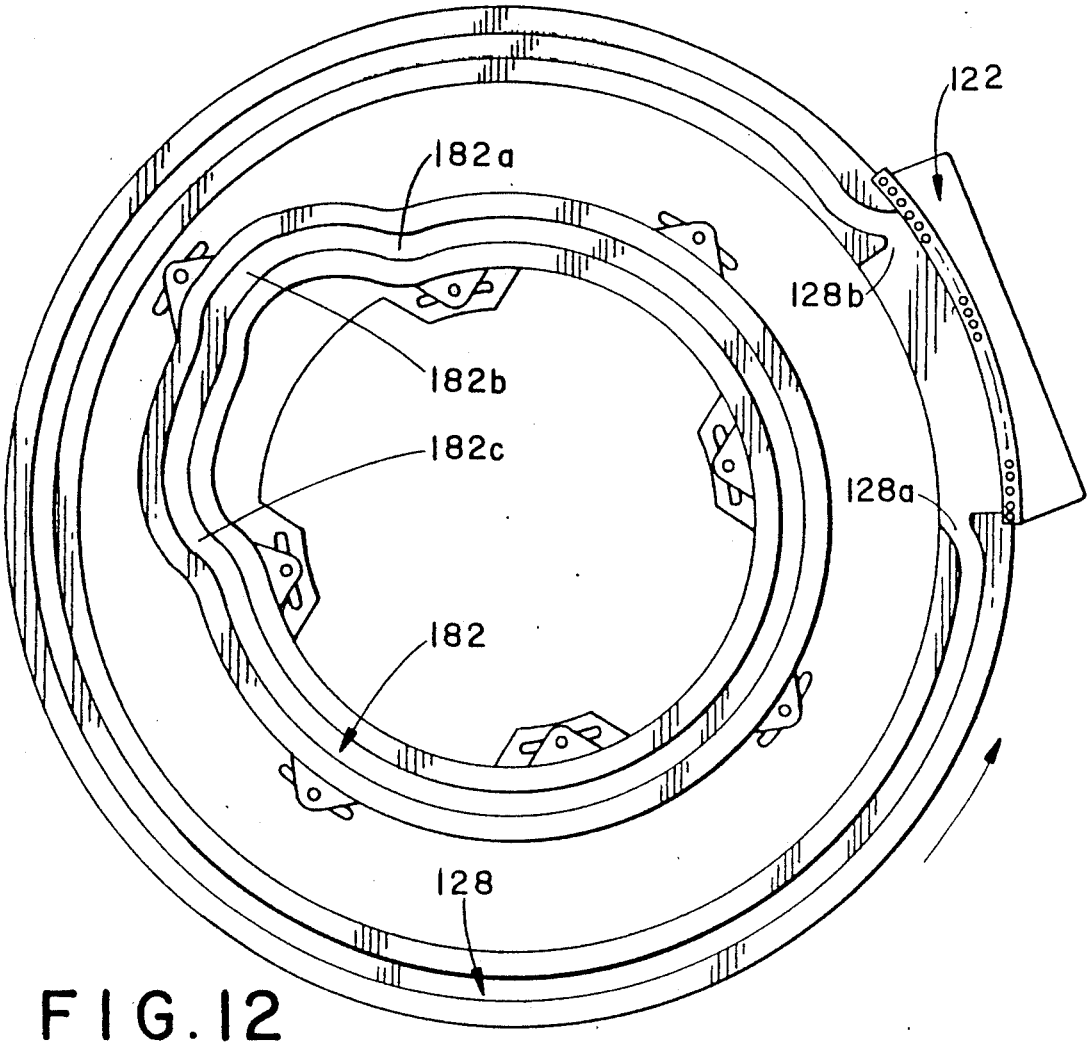
FIG. 12 is a plan view of an interior face of a frame side plate illustrating the roller cam track and pocket lift/tilt cam track; and, FIG. 13 is an elevational view of the drum with selected elements removed therefrom and illustrating the radial and tilting movement of the pockets during rotation of the drum.

The means for actuating radial movement of each pocket includes a pair of lift rod members 164, 166 (FIGS. 7–9). Rod member 164 is pivotally secured to drum sidewalls 168, 170 and is generally cylindrical in conformation except along a notched face 172. The notched face abuttingly engages the associated pocket sidewall 92. The rod member 164, though, is not secured to the sidewall 92 but allows sliding movement therewith. On the other hand, the lift rod member 166 is also notched along one face 174 but is secured through a known fastening arrangement such as bolts 176 to the sidewall 94 of the pocket. A pivot or link arm 178 extends between the lift rod members 164, 166, preferably one link arm at each end of the pocket (FIG. 7). Further, a second cam roller 180 is disposed on a right-hand end of lift rod member 166. The second cam roller is received in a second cam track 182 defined in cam plate 130. As the drum rotates relative to the cam plate 130, the second cam roller rides in the second cam track and radially shifts as a result of the predetermined cam track configuration (FIG. 12).

As illustrated in FIGS. 7 and 8, the pocket is in a radially recessed position. In the recessed position lift rod member 166 is disposed closer to the central axis of the drum than lift rod member 164. As the second cam track 182 increases its diameter along the track region 182*a* to 182*b* the second cam roller 180, and likewise lift rod member 166, move to a radially outer position that lifts the pockets to a radially outer position as shown in FIG. 9. Since lift rod member 164 is secured to the drum sidewalls, the lift rod member 166 pivots thereabout and lifts the pocket relative to the drum sidewalls.

Of course the radial outward of lifting movement of the pocket is defined by the second cam roller movement in track 182. To accommodate this movement, the drum sidewalls 168, 170 have a scalloped configuration. The scalloped configuration is akin to a sinusoidal curve. Lift rod member 164 is secured at the low points of the curve and the high points of the curve define a recess in which lift rod member 166 extends in its radially outermost position (FIG. 9)

As the pocket is lifted radially outward, it also undergoes a closing action as the sidewalls 92, 94 move toward one another. To effect this closing relationship, a cam block 190 is disposed along an interior face of each drum sidewall 168, 170. The cam blocks are of substantially identical construction, the right-hand cam block being a mirror image of the left-hand cam block. Each cam block has third and fourth cam tracks 192, 194 defined therein for opening and closing the pockets. First and second opening/closing rod members 196, 198 are associated with each pocket. Each of the rod members 196, 198 extends over the entire width of the pocket, and is secured to respective sidewalls 92, 94 of the pocket by fastening means 176. Each of the rod members 196, 198 has a notched face 200, 202, respectively, that defines a planar surface to conform to the pocket sidewalls.

Moreover, the radially outer end of sidewall 92 has a hinged upper portion 210 that pivots around pivot bar 212 secured to the exterior face of pocket sidewall 94. An arm 214 extends from the pivot bar to permit articulated movement of the upper portion 210 secured at the outer end of the arm. A spring 215 biases the upper sidewall portion 210 toward a closed position with sidewall 94. In the preferred embodiment the spring 215 is a torsion spring received around pivot bar 212. On the other hand, means for opening the pocket against the spring bias is defined by cam rollers 216 on opposed ends of rod member 196 and cam rollers 218 disposed on opposite ends of rod member 198. The cam rollers 216 are received in the cam tracks 192 (FIG. 10) while cam rollers 218 are received in the cam tracks 194. The predetermined configuration of the cam tracks 192, 194 is adapted to hold the pockets in an open position when the pocket is radially recessed, move the first and second sidewalls 92, 94 toward one another during an intermediate range of radial outward movement of the pockets, and close the sidewall 94 toward sidewall 92 in the radially outermost movement of the pocket.

Figure 10:
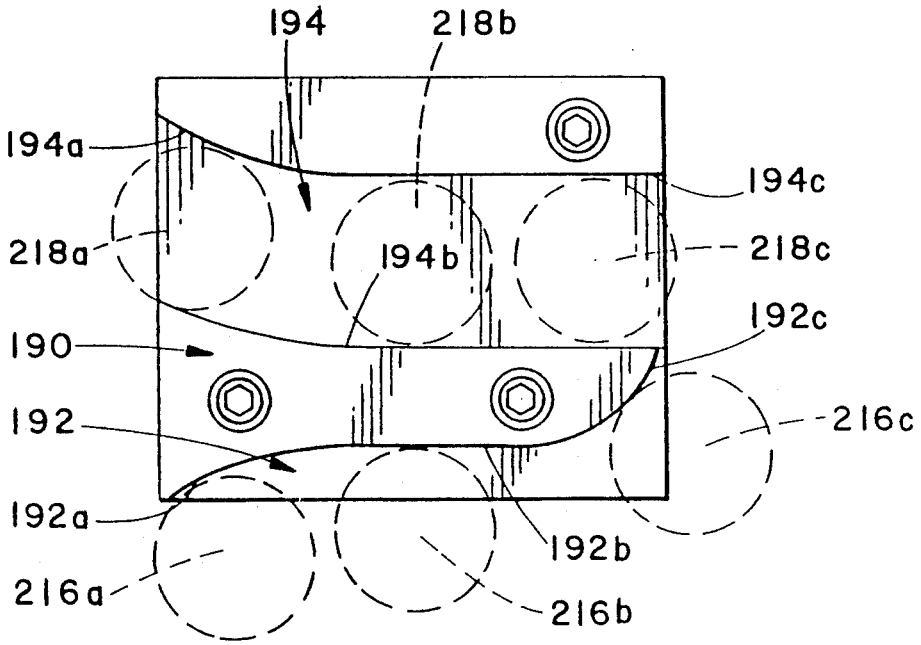
FIG. 10 is a plan view of a cam block incorporating a pair of cam tracks for selectively opening and closing the pockets.
Figure 11:
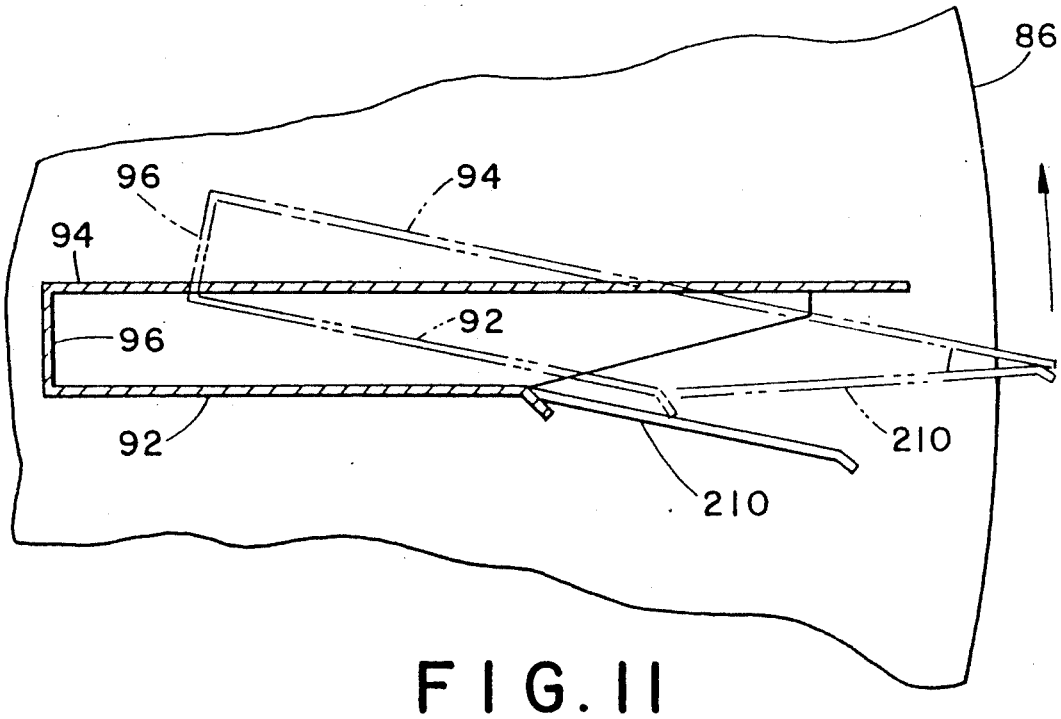
FIG. 11 is a cross-sectional view of a pocket with a pocket tilt position generally illustrated in phantom.

As particularly illustrated in FIG. 10, those portions of each cam track 192, 194 denoted by suffix "a" represent the position of cam rollers 206, 208 when the pocket is in a recessed and open position corresponding to FIG. 8. The region denoted by suffix "b" indicates intermediate radial outward movement of the pocket toward a closing position. Lastly, suffix "c" illustrates the closed and outermost radial position of the pocket as illustrated in FIG. 9.

As indicated above, tilting of the pocket is also effected to facilitate ingress and egress of the sheet products into the pockets. The tilting of the pockets results from the pivotal arrangement of the lift rod members 164, 166 cooperating with the opening/closing rod members 196, 198. That is, as the second cam roller 180 travels in cam track 182 through the path 182*a* to 182*b* the pocket is lifted radially outward. Simultaneously, the constraint imposed on the upper portion of each pocket in cam tracks 192, 194 results in the lower or bottom portion of the pocket pivoting around rod member 164 to effect a tilting of the pocket.

Tilting also occurs as the pockets are radially recessed from their FIG. 9 position, i.e., as the cam roller 180 travels through the cam track path 182*b* to 182*c* (FIG. 12). The tilting of the pockets is designed to facilitate ingress of the papers as the rollers urge the individual sheet products therein. Alternatively, the pockets are tilted in the opposite direction to facilitate egress of the papers as individual grippers 220 on the gripper conveyor mechanism C grasp and remove the sheet products from the pockets.

In summary, a stack D of sheet products SP are urged toward drum 80 by a series of toothed belts. The vibrating plate 48 orients and aligns the sheet products as they travel through the infeed mechanism. Gate pins 70, 72 assist in separation and advancement of the sheet products. The drum 80 rotates and positions peripherally arranged rollers 104 for engagement of the lower fold edge of the sheet products. The rollers are freed for rotation relative to the drum, selectively connected to a source of vacuum to assist in gripping the sheet products, and rotated to urge the individual sheet products into selective pockets. Drum rotation continues through approximately 150° from the sheet product infeed mechanism. At that point, the second cam roller 180 has advanced into the second cam track portion 170*a* to 170*b* and begins to tilt and lift the pockets radially outward. As the pockets move radially outward, cam tracks 192, 191 cooperate with cam rollers 216, 218 to close the pocket sidewalls 92, 91 and grip the looseleaf or free end of the sheet product. As shown in FIG. 9, the pocket is closed and located at its radially outermost position where a selected gripper 220 can grasp the free end of the sheet product and remove sheet product from the pocket against the bias of spring 198. The gripper conveyor mechanism then transports the sheet products individually for further processing downstream. Thereafter, cam roller 180 follows the path from 170*b* to 170*c* to radially recess and open the pockets.

Figure 13:
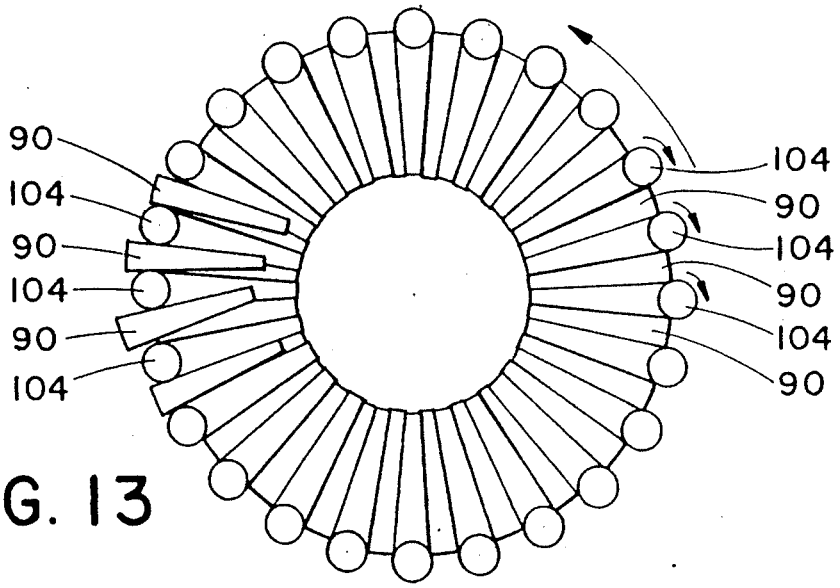

As particularly illustrated in FIG. 13, the tilting and radial disposition of the pockets is shown in a freeze-frame condition where the effect of the cam rollers and cam tracks have lifted, tilted, and closed the pockets from the infeed mechanism toward the outfeed area adjacent the conveyor mechanism. The remainder of the drum movement back toward the infeed mechanism, again, radially recedes the pockets and opens them for receipt of individual sheet products as the cycle continues.

The invention has been described with reference to the preferred embodiment. Obviously modifications and alterations will occur to others upon a reading and understanding of this specification. It is intended to include all such modifications and alterations insofar as they come within the scope of the appended claims or equivalents thereof.

Having thus described the invention it is now claimed:

1. An apparatus for processing an associated stack of sheet products comprising:

a drum rotatable about a central axis;

plural, generally radially disposed pockets defined in said drum having first and second sidewalls defining pocket openings at selected peripheral portions of said drum adapted to receive the sheet products therein;

means for urging one of the sheet products from the associated stack into a selected pocket, the urging means including plural rollers disposed adjacent the periphery of said drum between said pocket openings, the rollers being selectively rotatable and including a suction means selectively connected to a source of vacuum for gripping the sheet product from the stack and means for connecting the suction means to the vacuum source through approximately 90° of roller rotation to grip the sheet product adjacent one edge thereof for advancing a sheet product into the pockets as the drum rotates; and means for rotating the rollers around roller axes during a first preselected portion of the drum rotation.

2. The apparatus as defined in claim 1 further comprising first means for selectively actuating movement of said pocket sidewalls toward and away from one another to grip the associated sheet products.

3. The apparatus as defined in claim 2 wherein said first actuating means includes a first cam member disposed on a pocket sidewall, said first cam member received in a first cam track.

4. The apparatus as defined in claim 1 further comprising means for biasing said first and second pocket sidewalls to one of an open and closed position.

5. The apparatus as defined in claim 1 further comprising second means for actuating radial movement of said pockets toward and away from the periphery of said drum.

6. The apparatus as defined in claim 1 wherein said roller rotating means includes a sprocket disposed adjacent to one end of each roller selectively engaging a rack for rotating said rollers in a direction opposite to rotation of the drum.

7. The apparatus as defined in claim 1 further comprising means for preventing rotation of said rollers during a second preselected portion of said drum rotation.

8. The apparatus as defined in claim 1 further comprising means for tilting said pockets to assist ingress and egress of sheet products from said pockets.

9. An apparatus for processing an associated stack of sheet products comprising:

a drum rotatable about a central axis;

plural, generally radially disposed pockets defined in said drum having a bottom wall and first and second sidewalls extending from the bottom wall and defining pocket openings at selected peripheral portions of said drum adapted to receive the sheet products therein;

plural rollers disposed adjacent the periphery of said drum between said pocket openings adapted to operatively engage one of the sheet products from the associated stack and facilitate entry into a selected pocket; and, first means for actuating radial movement of said pocket sidewalls and bottom wall toward and away from the periphery of said drum.

10. The apparatus as defined in claim 9 further comprising second means for selectively actuating movement of said pocket sidewalls toward and away from one another to grip the associated sheet products.

11. The apparatus as defined in claim 9 further comprising means for tilting said pockets to assist in ingress and egress of sheet products from said pockets.

12. An apparatus for processing an associated stack of sheet products comprising:

a drum rotatable about a central axis;

plural, generally radially disposed pockets defined in said drum and having first and second sidewalls defining pocket openings at selected peripheral portions of said drum adapted to receive the sheet products therein;

plural rollers disposed adjacent the periphery of said drum between said pocket openings adapted to operatively engage one of the sheet products from the associated stack; and facilitate entry into a selected pocket; and, means for tilting said pockets relative to the drum to assist ingress and egress of sheet products from said pockets.

13. The apparatus as defined in claim 12 further comprising first means for selectively actuating movement of said pocket sidewalls toward and away from one another to grip the associated sheet products.

14. The apparatus as defined in claim 12 further comprising means for rotating said rollers around roller axes during a first preselected portion of said drum rotation.

15. The apparatus as defined in claim 14 further comprising means for preventing rotation of said rollers during a second preselected portion of said drum rotation.

16. The apparatus as defined in claim 12 wherein each of said rollers includes a suction means adapted for selective connection to an associated source of vacuum for gripping a sheet product and urging the sheet product in one of said pockets.

17. An apparatus for processing an associated stack of sheet products comprising:

a drum rotatable about a central axis;

plural, generally radially disposed pockets defined in said drum and having first and second sidewalls defining pocket openings at selected peripheral portions of said drum adapted to receive the sheet products therein;

means for urging one of the sheet products from the associated stack into a selected pocket, the urging means including plural rollers disposed adjacent the periphery of said drum between said pocket openings, the rollers being selectively rotatable and advancing a sheet product into the pockets as the drum rotates, and first means for selectively actuating movement of said pocket sidewalls toward and from one another to grip the associated sheet products, the first actuating means including a first cam member disposed on a pocket sidewall, the first cam member being received in a first cam track of the drum.

* * * * *